US009421581B2

(12) United States Patent
Winkler

(10) Patent No.: US 9,421,581 B2
(45) Date of Patent: Aug. 23, 2016

(54) SWIMMING POOL CLEANING DEVICE

(71) Applicant: Mariner 3S AG, Remigen (CH)

(72) Inventor: Roland Winkler, Wil (CH)

(73) Assignee: MARINER 3S AG, Remigen (CH)

( * ) Notice: Subject to any disclaimer, the term of this patent is extended or adjusted under 35 U.S.C. 154(b) by 41 days.

(21) Appl. No.: 14/243,187

(22) Filed: Apr. 2, 2014

(65) Prior Publication Data

US 2014/0298601 A1 Oct. 9, 2014

(30) Foreign Application Priority Data

Apr. 5, 2013 (EP) ..... 13405043

(51) Int. Cl.

| | |
|---|---|
| ***E04H 4/16*** | (2006.01) |
| ***B08B 3/02*** | (2006.01) |
| ***B08B 9/093*** | (2006.01) |
| *B08B 1/00* | (2006.01) |

(52) U.S. Cl.

CPC ..... *B08B 3/024* (2013.01); *B08B 9/093* (2013.01); *B08B 9/0936* (2013.01); *E04H 4/16* (2013.01); *E04H 4/1654* (2013.01); *E04H 4/1663* (2013.01); *B08B 1/002* (2013.01); *E04H 4/1681* (2013.01)

(58) Field of Classification Search

CPC ..... E04H 4/16; E04H 4/1654; E04H 4/1663; E04H 4/1681

USPC ..... 15/1.7

See application file for complete search history.

(56) References Cited

U.S. PATENT DOCUMENTS

| | | | | |
|---|---|---|---|---|
| 5,542,141 | A * | 8/1996 | Albright | 15/1.7 |
| 2003/0208862 | A1 * | 11/2003 | Henkin et al. | 15/1.7 |
| 2004/0074524 | A1 * | 4/2004 | Horvath et al. | 134/22.18 |
| 2006/0282962 | A1 * | 12/2006 | Henkin et al. | 15/1.7 |
| 2013/0133144 | A1 * | 5/2013 | Erlich et al. | 15/1.7 |

FOREIGN PATENT DOCUMENTS

| | | | |
|---|---|---|---|
| AT | 6 644 | U2 | 1/2004 |
| EP | 1 551 571 | | 6/2008 |
| EP | 1 997 567 | A1 | 12/2008 |
| JP | 2001-276754 | A | 10/2001 |
| WO | 2004/035237 | A2 | 4/2004 |
| WO | WO 2011100067 | A1 * | 8/2011 |

OTHER PUBLICATIONS

Extended European Search Report for 13 40 5043 dated Aug. 28, 2013.

* cited by examiner

*Primary Examiner* — Michael Jennings
(74) *Attorney, Agent, or Firm* — Pearne & Gordon LLP

(57) ABSTRACT

An innovative cleaning device (1) is described, more particularly for the cleaning of swimming pools and ornamental pools having a casing, a casing base (13), with at least one suction opening (14, 15) arranged on the casing base, a pump (20, 21) connected to the suction opening and conveying fluid to be cleaned into the casing, an actuator for moving and at least one nozzle (27) which is connected to a high-pressure water pump. Also provided is a rotor (25) with at least one arm (26) arranged in a rotatable manner in the casing, the end area of which has the nozzle (27) directed at the bottom of the pool.

8 Claims, 3 Drawing Sheets

SWIMMING POOL CLEANING DEVICE

Figure 1:
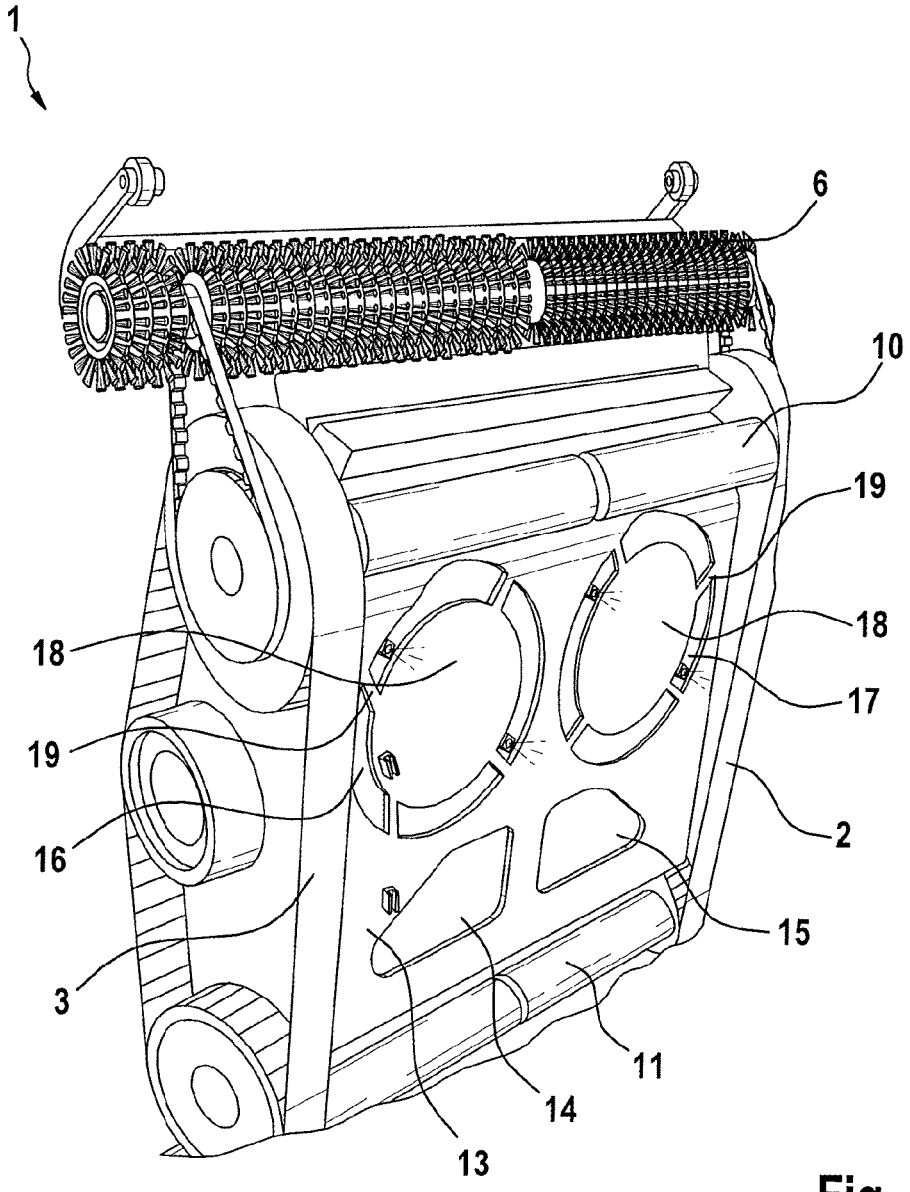

The invention relates to a cleaning device, more particularly for the cleaning of swimming pools, in accordance with the introductory section of claim 1.

Swimming pool cleaning robots are used professionally, particularly in Olympic-sized swimming pools or large hotel pool complexes. The robots which are known to date can travel automatically from the edge of the pool into the water, submerge themselves, pull the electric cable behind them and by way of various navigation systems, depending on their configuration, can systematically traverse the entire bottom of the swimming pool and finally re-emerge at the place where the robots started work. The operator then only has to clean the filter with a few turns. The robot is fitted with brushes as well as coarse and fine filters. During cleaning only the dirt that has accumulated on the bottom of the swimming pool is loosened and trapped in the filters by means of an electric circulating pump.

Professional swimming pools are typically equipped with external, very powerful circulating pumps in order to chemically treat and filter the water. UV treatments of the water to be treated are often also provided. Through this the water is mostly optically clean and the chemical additives prevent the formation of algae.

Outdoor swimming pools are usually closed in winter, but for structural reasons the water normally remains in the pool during overwintering so that it then becomes very dirty and various types of algae form. Some algae cannot adhere very well to the walls which have a smooth surface. Often the walls are coated with films treated with chemical substances to prevent the growth of algae. However, in the case of tiles the algae can become lodged in the joints. Some algae, particularly black algae, adhere almost unremovably, particularly to the bottom.

However, the use of conventional underwater robots is by far not enough in order to completely clean a swimming pool of this type when it brought back into use. Before resumption of use, the swimming pool water is therefore completely drained or pumped out and the personnel must work strenuously using their hands and feet to clean the swimming pool. In doing so, chemicals and brushes of different hardnesses are typically used. Special shoes also have to be worn in order to create enough adhesion on the bottom of the pool. Brushes are also attached to the shoes in order to achieve an increased pressure on the brush through the weight of the body. This is an expensive and time-consuming procedure every year. Alternatively high-pressure washers can be used, particularly to eliminate algal growth and biofilm.

In recent times increasing numbers of natural pools or open-air pools with biological water treatment have been built in which the water is also circulated, but is cleaned by way of natural water treatment. Thus, for example, the water is filtered through a natural pond or pool bottom which also contains plants. The purpose of these natural pools or open-air swimming pools with biological water treatment is to use as little fresh water as possible and no chemical additives. The walls and bottom of these natural pools and open-air swimming pools are generally built of natural stones which normally have a rougher surface than conventional swimming pools. Due to the stronger algal growth, the cleaning of such natural pools or open-air swimming pools is hardly possible with conventional swimming pool cleaning robots.

In order to clean such natural pools or open-air swimming pools with biological water treatment, rolling brushes are therefore used which have longer bristles and are coated with abrasive material. The brushes then have to be regularly replaced, which results in increased costs and in spite of this the cleaning performance is still unsatisfactory. For this reason another solution is chosen in that additional personnel clean the natural pools or open-air swimming pools with biological water treatment from the edge of the pool using hand-held brushes or with high-pressure washers.

Described in EP-A-1 551 571 is a cleaning device with high-pressure cleaning jets which are directed at the surface of the swimming pool to be cleaned by means of offset pipes at a flat angle of around 5° to 10°. Cleaning with the high-pressure jets therefore takes place in a relatively narrow strip, so that the cleaning robot has to travel at last three times the normal distance in order to cover the whole bottom of the swimming pool. Furthermore, cleaning the edge areas of the swimming pool with the high-pressure jets is not possible.

The aim of the present invention is based on avoiding said drawbacks and providing a swimming pool cleaning device that allows efficient and more cost-effective cleaning of professional swimming pools and also natural pools and open-air swimming pools with biological water treatment and also ornamental pools.

This is achieved by a swimming pool cleaning device with the features of claim 1.

The cleaning device in accordance with the invention has the great advantage that a swimming pool can now be cleaned at considerably less cost and much more quickly, with strongly adhering dirt being loosened and removed.

Figure 2:
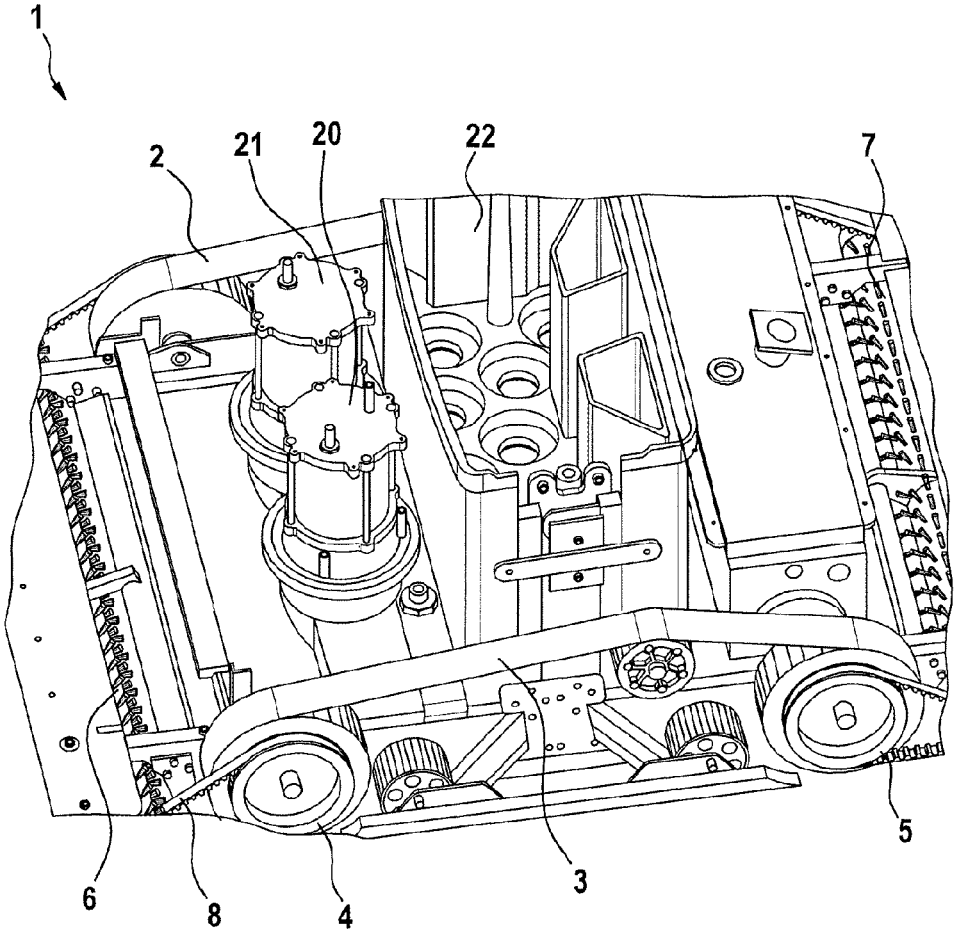
Figure 3:
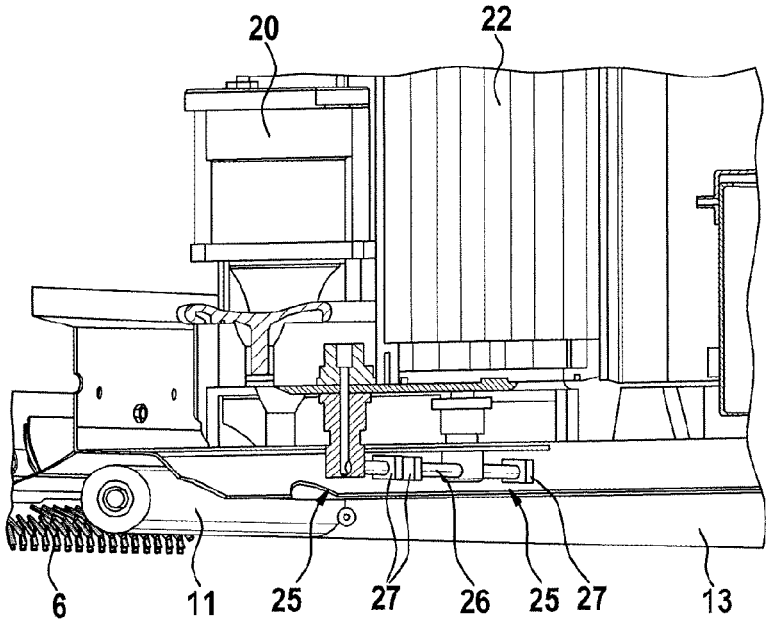
Figure 4:
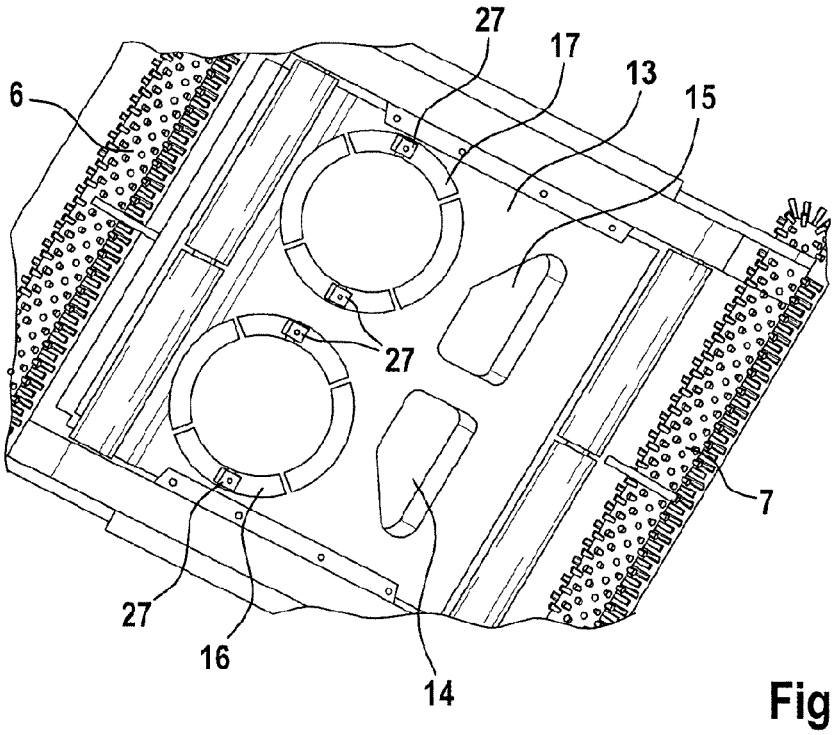

Further details of the invention and, in particular, examples of embodiments of the cleaning device in accordance with the invention are described below with the aid of the attached drawings. In these:

FIG. 1 shows the underside of a cleaning device with high-pressure cleaning, FIG. 2 shows a view from above of the cleaning device without the usual casing, FIG. 3 a side view of the cleaning device, also without the casing, and FIG. 4 shows the underside of the cleaning device.

Unless otherwise stated, in the figure the same reference numbers are used for the same elements.

FIG. 1 shows a perspective view of a cleaning device 1 for cleaning swimming pools having on the sides two caterpillar tracks 2 and 3 with internal toothing which are each fastened between two gearwheels 4 and 5 driven by an electric motor (not visible). Provided at the front and back are brush rollers 6 and 7 which are also driven by the gearwheels 4 and 5 via a toothed belt 8 (see FIG. 2). Arranged between the front gearwheels 4 is a front axle 10 and between the rear gearwheel 5 a rear axle 11. Also provided is a casing (not shown) with a casing base 13 which at the back has two trapezoidal suction openings 14 and 15 arranged next to each other and at the front two circular cut-outs 16 and 17 arranged next to each other which are formed by a central circular plate 18 and bars 19 connected to the casing base 13.

As can be seen from FIG. 2, a suction pump 20 is provided above the suction opening 14 and a suction pump 21 is provided above the suction opening 15. Purely schematically a filter housing 22 for the (not shown) cleaning filters is provided.

In FIGS. 3 and 4, on the underside of the cleaning device 1, just above the housing base 13 two rotors 25 with a rotor arm 26 are attached to a compressed water pipeline, the ends of which are each provided with a nozzle 27. The outlet openings of the nozzle 27 are aligned with regard to the casing base 13 at an angle of 10° to 25° to the perpendicular so that the emerging high-pressure water jet hits the surface to be cleaned at an angle of 10° to 25°. As a result of this the rotor

25 is automatically rotated by the high-pressure water jet. Depending on the pressure of the water jet and diameter of the outlet opening of the nozzle 27 faster or less fast rotation is achieved. A rotation speed of 100 to 600 revolutions per minute has proven to be extremely effective for the cleaning of areas of the pool bottom affected by black algae. The distance between the nozzles 27 and the bottom of the pool is around 3 to 4 cm. The rotors 25 can also be rotated through the actuation of the gearwheels 4 and 5 or by way of a separate motor. The circular or cover plate 18 prevents the rotary movement of the rotor 25 being impeded by large items of debris such as small twigs.

The high-pressure water pump (not shown) for the high-pressure water jet is set up outside the swimming pool and is connected via a reinforced hose to the high-pressure water pipeline of the cleaning device 1. This hose can be connected to the device power supply cable for the suction pumps 20 and 21, for the electric actuating motor and for the electrical controller. Additionally this cable connected to the hose can be provided with buoyancy elements or floats so that the hose floats on the water and does not hinder the cleaning device 1 during its to and from movements over the bottom of the pool.

The water that is supplied to the high-pressure water pump can be taken directly from the swimming pool. The high-pressure water pump produces a water pressure of 100 to 300 bars. The normal cleaning pump capacity of the cleaning device 1 is around 5 to 15 liters per second and by drawing this quantity of water through the large suction openings 14 and 15 the cleaning device is held by suction on the floor of the pool so to speak. In spite of the high-pressure water jet, this suction effect keeps the cleaning device on the bottom as the suction pressure is considerably greater than the opposing force produced by the water jet emerging from the nozzle outlets. With the rotating water jet the dirt adhering to the swimming pool is loosened and sucked away through the suction opening 14 and 15 by the pumps 20 and 21.

The cleaning device 1 can also be designed without brush rollers and simply be fitted with running wheels or running rollers in order to be attached as a trailer to an existing cleaning robot. This allows simple and cost-effective upgrading of existing cleaning systems.

What is claimed is:

1. Cleaning device (1), more particularly for cleaning swimming pools and ornamental pools, having a casing, a casing base (13), with at least one suction opening (14, 15) arranged on the casing base, a pump (20, 21) connected to the suction opening and conveying fluid to be cleaned into the casing, an actuator for moving and at least one nozzle (27) which is connected to a high-pressure water pump characterised in that a rotor (25), with at least one arm (26) arranged in a rotatable manner, are provided in the casing, wherein the end area of the at least one arm has the nozzle (27) directed at the bottom of the pool, and wherein the at least one arm extends from the rotor to the nozzle within the casing, and the at least one arm and the nozzle are located above the casing base.

2. Cleaning device according to claim 1 characterised in that the nozzle (27) is arranged relative to the casing base (13) at an angle of 10° to 25° to the perpendicular.

3. Cleaning device according to claim 1 characterised in that the arm (26) is rotatable about its mid-point and has a nozzle (27) at each of the two end areas.

4. Cleaning device according to claim 1 characterised in that the high-pressure water pump produces a water pressure of 100 to 300 bars.

5. Cleaning device according to claim 1 characterised in that the nozzle (27) has a throughput of 5 to 15 liters of water per second.

6. Cleaning device according to claim 1 characterised in that the rotational speed of the rotor (25) is between 100 and 600 revolutions per minute.

7. Cleaning device according to claim 1 characterised in that the rotor (25) is covered with or without a circular plate (18) and a circular cut-out (16, 17) is provided in the area of the nozzle (27).

8. Cleaning device (1), more particularly for cleaning swimming pools and ornamental pools, having a casing, a casing base (13), with at least one suction opening (14, 15) arranged on the casing base, a pump (20, 21) connected to the suction opening and conveying fluid to be cleaned into the casing, an actuator for moving and at least one nozzle (27) which is connected to a high-pressure water pump characterised in that a rotor (25), with at least one arm (26) arranged in a rotatable manner, is provided in the casing, wherein the end area of the at least one arm has the nozzle (27) directed at the bottom of the pool and wherein the rotor (25) is covered with a circular plate (18) rigidly connected to the casing base (13) and a circular cut-out (16, 17) is provided in the area of the nozzle (27).

* * * * *